United States Patent [19]

Maruyama et al.

[11] Patent Number: 4,580,949

[45] Date of Patent: Apr. 8, 1986

[54] SLIDING VANE TYPE ROTARY COMPRESSOR

[75] Inventors: Teruo Maruyama, Hirakata; Tadayuki Onoda, Toyonaka, both of Japan

[73] Assignee: Matsushita Electric Industrial Co., Ltd., Osaka, Japan

[21] Appl. No.: 713,745

[22] Filed: Mar. 19, 1985

[30] Foreign Application Priority Data

Mar. 21, 1984 [JP] Japan ..... 59-54718

[51] Int. Cl.[4] ..... F04B 49/02

[52] U.S. Cl. ..... 417/292; 417/295; 417/505; 418/15

[58] Field of Search ..... 417/292, 295, 505; 418/15

[56] References Cited

U.S. PATENT DOCUMENTS 4,407,639 10/1983 Maruyama ..... 417/292

FOREIGN PATENT DOCUMENTS 55-69787 5/1980 Japan ..... 417/295

58-158390 9/1983 Japan ..... 418/15

59-58181 4/1984 Japan ..... 417/292

*Primary Examiner*—Richard E. Gluck

*Attorney, Agent, or Firm*—Spencer & Frank

[57] ABSTRACT

A sliding vane type rotary compressor has at least two suction ports through which a refrigerant is sucked into the vane chamber. A combination of a spring made of a shape memory alloy adapted to expand and contract when supplied with an electric current and a spool operative by the spring is disposed in a flow passage through which the source of the refrigerant is connected to one of the suction ports leading to a region of higher magnitude of compression. The flow passage is opened and closed by the spool which is moved by the expansion and contraction of the spring of the shape memory alloy in response to the heat produced by the self heat build-up action when supplied with an electric current and also to the cooling function of the refrigerant of low temperature, thus attaining a variable capacity control of the compressor with a simple and compact construction.

9 Claims, 14 Drawing Figures

SLIDING VANE TYPE ROTARY COMPRESSOR

BACKGROUND OF THE INVENTION

The present invention relates to a sliding vane type rotary compressor which is used, for example, in an automobile air conditioner.

The current demand for energy saving has given rise to the demand for higher efficiency compressors for use in refrigerating cycles. In particular, compressors used in car air conditioners encounter the following problems: namely, (1) refrigerating capacity becomes excessively large during high-speed operation due to the fact that the compressor is forcibly driven by an associated engine at speeds proportional to the engine speed, and (2) the heat load condition on a heat exchanger varies largely in accordance with changes in the environmental condition and running condition of the automobile on which the compressor is mounted.

In order to ensure an adequate refrigerating conditions by overcoming these problems peculiar to air conditioners, methods have been proposed for allowing control of the volume displacement of the compressor from the outside.

One of such methods is to release compression of gases by disengaging a delivery valve from the cylinder of the compressor by means of a solenoid valve. This method, however, requires a large space where the solenoid valve is mounted, so that it results in large overall size and an increased total weight of the compressor, as well as complications in the construction of the compressor. In addition, a careful selection of the materials is required in order to maintain a stable state of bonding between the coils of the solenoid which builds up heat under severe conditions of high temperatures and pressures, which in turn makes it difficult to fabricate the solenoid and raises the production cost.

SUMMARY OF THE INVENTION

Accordingly, an object of the invention is to provide a sliding vane type rotary compressor having a capacity control function, which is reduced remarkably in size as compared with a conventional sliding vane type rotary compressor in which a solenoid valve is used.

Another object of the invention is to provide a sliding vane type rotary compressor which can be used in combination with a known capacity control system such as the bypass type control system, quiescent cylinder type control system, or delivery valve floating type system.

Still another object of the invention is to provide a sliding vane type rotary compressor in which capacity control can be performed and which is suited to use not only in car conditioners but other types of air conditioners such as room air conditioners, package-type air conditioners and so forth.

To these ends, according to an aspect of the invention, there is provided a sliding vane type rotary compressor including a flat rotor provided in the outer peripheral surface thereof with vane grooves which slidingly receive vanes, a cylinder rotatably accomodating the rotor and having an inner peripheral surface along which the ends of the vanes slide, slide plates which are fixed to both sides of the cylinder and adapted to close axial ends of vane chambers which are formed by the vanes, the rotor and the cylinder, at least two suction ports formed in the cylinder or the side plate and adapted to allow a refrigerant to flow therethrough into the vane chamber, at least two flow passages providing communication between a source of the refrigerant and the vane chamber, and a delivery port formed in the cylinder or the side plate and adapted to allow the refrigerant compressed in the vane chamber to be delivered to the outside, wherein the improvement comprises: a spring made of a shape memory alloy adapted to expand and contract in response to the heat produced by a self heat build-up action thereof when supplied with an electric current and cooling effect produced by the refrigerant of a low temperature brought into contact therewith, the spring of the shape memory alloy being disposed in a portion of one of the flow passages leading to one of the suction ports which are communicatable with the region of a higher degree of compression; and a spool disposed in the portion of the one of the flow passages, the spool being adapted to be driven by the spring made of the shape memory alloy and adapted to open and close the flow passage by the force produced by the spring of the shape memory alloy.

According to an aspect of the invention, the sliding vane type rotary compressor further comprises a biasing spring adapted for cooperating with the spring of the shape memory alloy in holding the spool at a predetermined position.

In another aspect, the invention provides a sliding vane type rotary compressor of the type mentioned above, wherein one of the suction ports communicatable with the region of a higher degree of compression is formed in the side plate and a flow passage providing a communication between the source of the refrigerant and the suction port is formed in an intermediate plate disposed outside the side plates, the intermediate plate being provided with a through hole or aperture communicating with the flow passage, and wherein the rotary compressor comprises a spool disposed in the through hole and adapted to open and close the flow passage, a spring made of a shape memory alloy adapted to expand and contract in response to the heat produced by a self heat build-up action thereof when supplied with an electric current and cooling effect produced by the refrigerant of a low temperature brought into contact therewith, such as to drive the spool, and a biasing spring adapted for cooperation with the spring made of shape memory alloy in holding said spool at a predetermined position, the spring made of shape memory alloy and the biasing spring being accommodated by respective cases and disposed at both sides of the through hole.

These and other objects, features and advantages of the invention will become clear from the following description of the preferred embodiments when the same is read in conjunction with the accompanying drawings.

DESCRIPTION OF THE PREFERRED EMBODIMENTS

A preferred embodiment of the invention will be described hereinunder.

Figure 1:
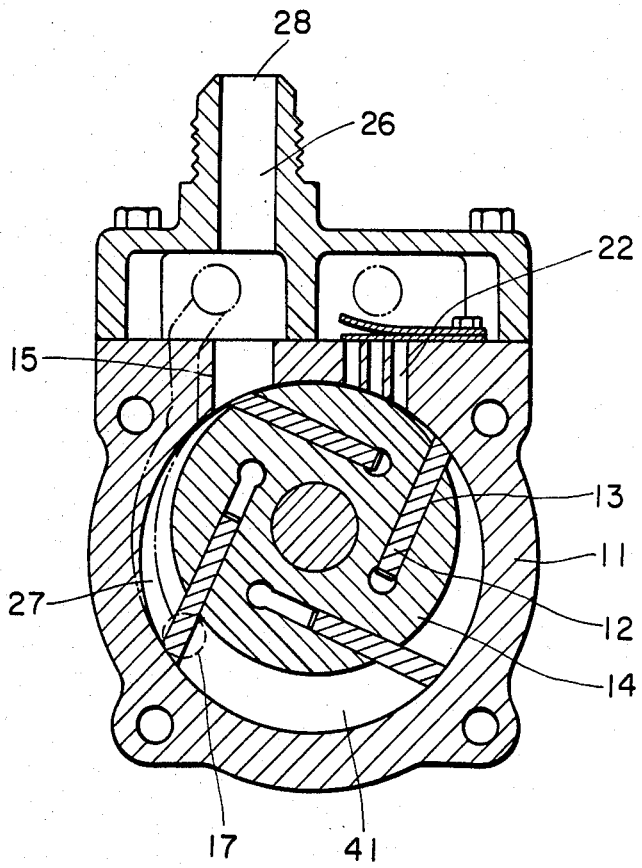
FIG. 1 is a sectional front elevational view of a sliding vane type rotary compressor in accordance with an embodiment of the invention.
Figure 2:
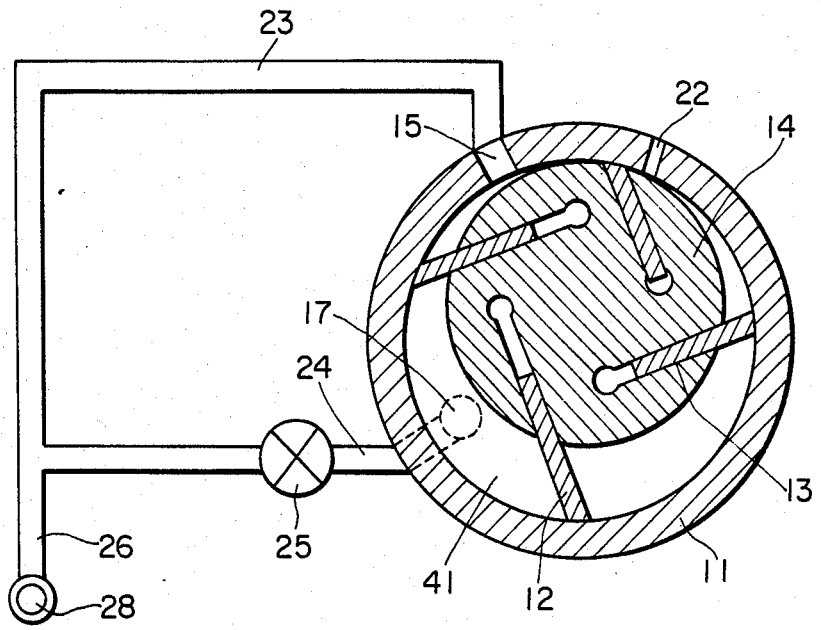
FIG. 2 is an illustration of two-port suction system incorporated in the sliding vane type rotary compressor of the invention.

FIG. 1 is a sectional front elevational view of a sliding vane type rotary compressor in accordance with the invention, while FIG. 2 is a diagrammatic illustration of a refrigerant flow passage for explaining the principle of the refrigerating capacity control in the invention. Referring to these Figures, the sliding vane type rotary compressor of the invention has a cylinder 11 accommodating a rotor 14 which is provided with a plurality of vane grooves 13 for receiving vanes 12. The cylinder 11 has a first suction port 15, second suction port 17 and a discharge port 22. A first flow passage 23 and a second flow passage 24 lead to the first suction port 15 and the second suction port 17, respectively. The second flow passage 24 is provided with a valve 25. The first and the second flow passages 23 and 24 branch from a common flow passage 26 leading from a source 28 of a refrigerant. The vanes 12, rotor 14 and the cylinder 11 including the side plates define vane chambers 41 which may be referred to also as cylinder chambers.

Referring to FIG. 2, when the capacity control is dismissed, the refrigerant is fed to the vane chamber 41 both through the first suction port 15 and the second suction port 17. On the other hand, when the valve 25 in the flow passage 24 is closed so that the refrigerant is fed only through the first suction port 15 and the supply of the refrigerant through the second suction port 17 is cut off, it is possible to attain suppression effect of about 40 to 50% in the refrigerating capacity in the described embodiment of the invention.

Figure 3:
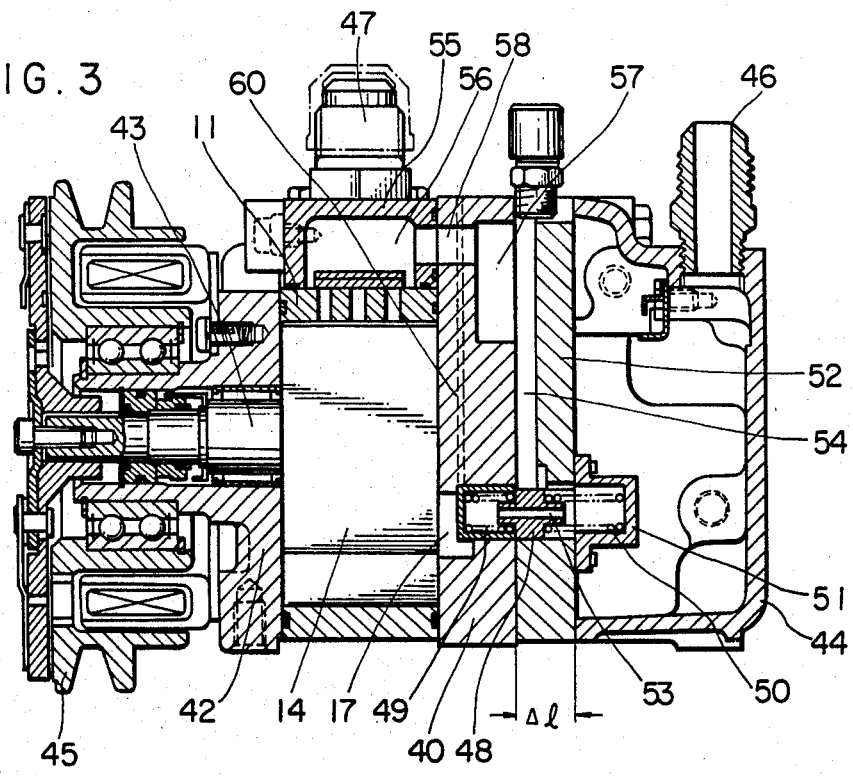
FIG. 3 is a sectional side view of the sliding vane type rotary compressor.

FIG. 3 is a sectional side view of the sliding vane type rotary compressor. As will be seen from this Figure, the compressor has a rear plate 40, a front plate 42, a rotor shaft 43, a rear case 44, an intermediate plate 52, and a clutch pulley 45. Reference numeral 46 denotes a pipe joint for a delivery pipe, while reference numeral 47 denotes a pipe joint for a suction pipe. Reference numeral 48 denotes a spool which is adapted to be operated by a compression spring 49 made of a shape memory alloy (referred to as the "SMA" spring, hereinunder). A bias spring 50 is accommodated by a spring storage case 51. Reference numeral 53 denotes a small orifice or through hole formed in the spool 48. Reference numeral 54 denotes a plate passage formed in the intermediate plate 52. A chamber 56 is formed in a head cover 55, while a vacant space 57 is formed in the rear plate 40. The vacant space 57 is communicated with the chamber 56 through a flow passage 58.

Figure 4A:
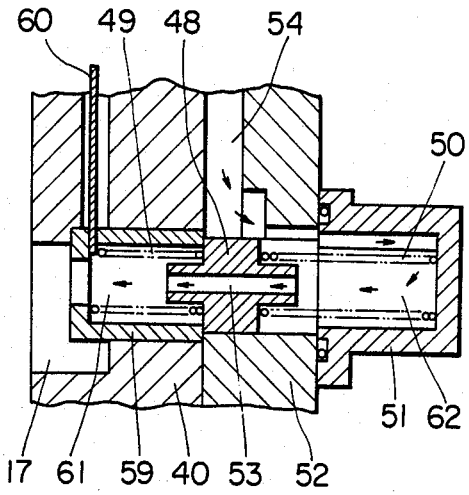
FIGS. 4A and 4B are sectional views of an essential part of an actuator incorporated in the sliding vane type rotary compressor of the invention.

Referring now to FIG. 4A, the SMA spring 49 is accommodated in an insulating case 59 made of ceramics and is provided at its one end with a terminal 60 for electric connection. Reference numerals 61 and 62 denote, respectively, a SMA spring chamber and a biasing spring chamber, respectively. The spool 48, SMA spring 49, bias spring 50 and the through hole 53 constitute a valve means which is electrically energized from the outside to open and close the flow passage. When this valve means opens the flow passage, the refrigerant is fed to the vane chamber 41 from the second suction port 17 via the pipe joint 47 for the suction pipe, chamber 56, vacant space 57, plate flow passage 54 and a flow passage (see FIG. 3) leading to the second suction port 17.

Figure 4B:
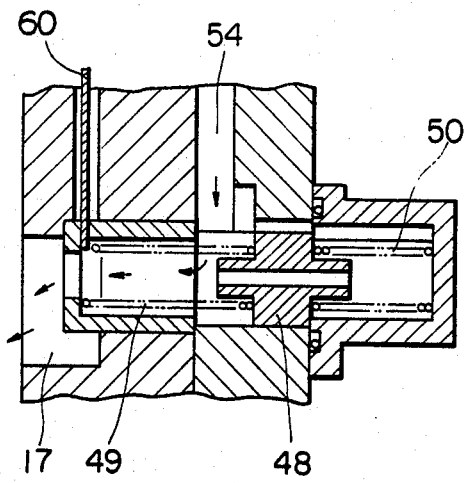

The operation of the valve means will be described hereinunder with specific reference to FIGS. 4A and 4B. The shape memory alloy used as the material for the SMA spring 49 is an Ni-Ti alloy having a transformation temperature range of 40° C. to 50° C., and is adapted to expand when its temperature is raised above the transformation temperature range. To electrically energize the SMA spring 49, it is housed by the case 59 which is made of ceramics and serves to electrically insulate the entire SMA spring from the outer walls. The electric terminal on one end of the SMA spring 49 is connected to an electric wire 60 which is extended through a small wiring hole formed in the rear plate 40 for connection to an external electric source such as a battery. The other end of the SMA spring 49 is electrically connected through the spool 48 to the bias spring 50 which in turn is electrically connected to the steel body of the compressor.

Thus, the other of the terminals of the electric source is grounded to the body of the compressor. FIG. 4A shows the state in which the electric source is turned off so that the SMA spring 49 is not supplied with electric power. In this state, the spool 48 has been moved to the left as viewed in the Figure by the restoring force $F_B$ of the bias spring 50 (compression spring), so that the second suction port 17 except for a refrigerant pressure equalizing flow through hole 53, is disconnected from the plate flow passage 54 communicating with the source of the refrigerant. At this time, the compressor is in the state wherein its refrigerating capacity is controlled. However, when the electric power is turned on, the SMA spring 49 is electrically energized to be raised in temperature due to its self heat build-up action. Then, as the temperature of the SMA spring 49 is raised beyond the transformation temperature, the restoring force $F_S$ produced in the SMA spring 49 comes to exceed the above-mentioned restoring force $F_B$, so that the spool 48 is moved to the right as shown in FIG. 4B. In consequence, the second suction port 17 is communicated with the plate flow passage 54, so that the suppression of the refrigerating capacity is dismissed.

It will be seen that, in the compressor of the invention, the refrigerating capacity can be controlled on occasion to be suppressed or released simply by turning on and off the voltage supplied from the battery which is provided externally. The through hole 53 centrally formed in the spool 48 is provided to eliminate any pressure difference across the spool 48, i.e., on the right and left sides of the spool 48. Therefore, the spool 48 is not moved by the refrigerant pressure regardless of whether electric power is in the ON or OFF state. Therefore, any erroneous operation due to fluctuation in the suction and discharge pressures of the compressor can be avoided advantageously. When the voltage is supplied to the SMA spring 49 as shown in FIG. 4B, the SMA spring is always subjected to the incoming and outgoing flow of the refrigerant and, hence, is cooled by the latter. Therefore, the state shown in FIG. 4B is rapidly shifted to the state shown in FIG. 4A when the electric power is cut off.

Figure 5:
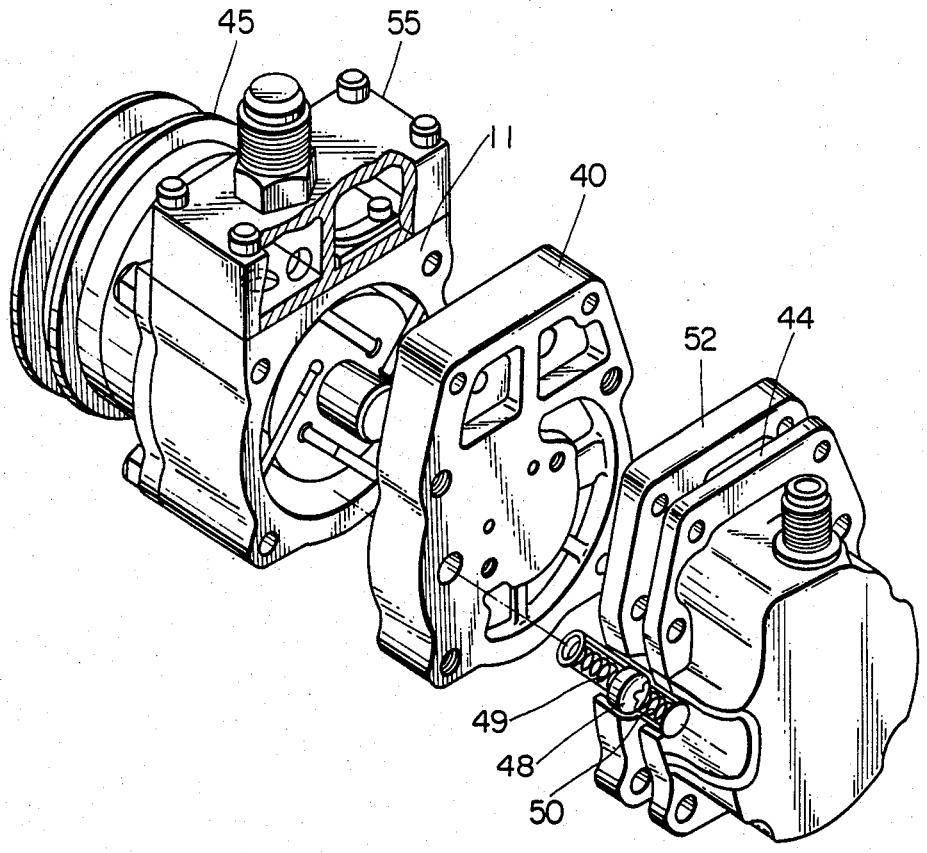
FIG. 5 is an exploded perspective view of a compressor in accordance with the invention.

The use of a shape memory alloy as an actuator has been proposed in various fields but such proposal has been unacceptably defective in that the actuator can have only poor response because of the large heat capacity of the shape memory alloy. In the described embodiment, however, a high value response characteristic can be obtained by making use of the fact that the refrigerant can serve as a cooling source. FIG. 5 is an exploded perspective view of the embodiment described hereinbefore.

Figure 6:
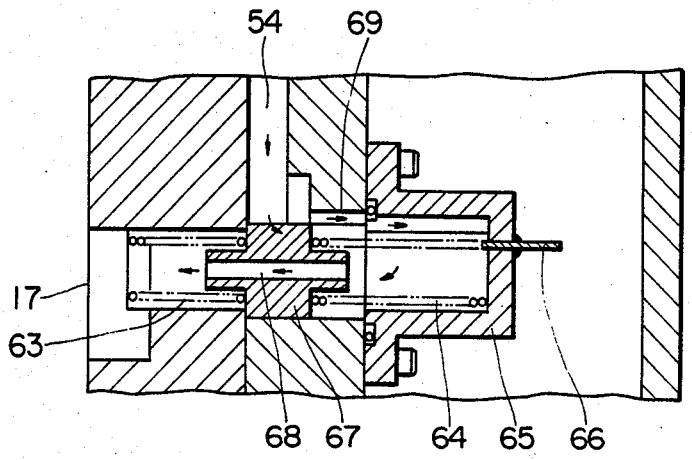
FIG. 6 is a sectional view of an essential part of another embodiment of the invention.

FIG. 6 shows another embodiment of the invention. In the first embodiment described before, the suppression of the refrigerating capacity is dismissed when the electric power supplied to the shape memory alloy is turned on. In contrast, in the embodiment shown in FIG. 6, the positions of the SMA spring and the bias spring are reversed from those shown in FIGS. 4A and 4B, in view of the fact that a car conditioner is frequently used with the suppression released. More specifically, in FIG. 6, reference numeral 63 denotes a bias spring, 64 denotes a SMA spring made of a shape memory alloy, 65 denotes a ceramic insulating case, 66 denotes an electric conductor connected to one end of the SMA spring 64, 68 denotes a through hole, and 69 denotes a groove formed as a flow passage. The valve means can also be rapidly shifted from the cut-off state (the SMA spring 66 is overheated) to the opened state. Namely, the refrigerant flows through the through hole 68 even in this state although the flow rate is extremely small, and this refrigerant effectively cools the SMA spring 64. According to this arrangement, it is possible to reduce the consumption of the electric power required for controlling the SMA spring.

In the described embodiments of the invention, the construction of the compressor as a whole is made compact due to the provision of an intermediate plate 52 between the rear plate 40 and the rear case 44. This is because the provision of the intermediate plate 52 permits the formation of the plate flow passage 54 through which the second suction port 17 is communicated with the valve means. In addition, the SMA spring 49 and the bias spring 50 can easily be received in a compact manner between the rear plate 40 and the rear case 44 through the intermediate plate 52.

Figure 7:
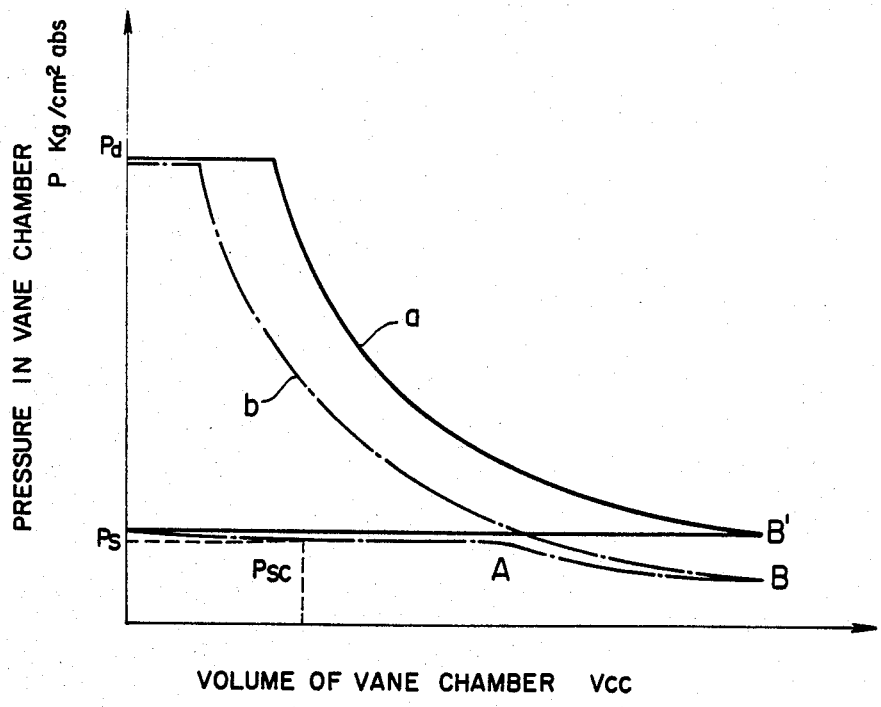
FIG. 7 is a PV diagram showing the operation characteristics of the sliding vane type rotary compressor of the invention.

FIG. 7 shows the P-V characteristics representing the relationship between the pressure P in the vane chamber and the volume V of the vane chamber. More specifically, the curve a in FIG. 7 represents the state wherein the refrigerating capacity control is not operative, while the curve b represents the state wherein the refrigerating power control is in effect. The pressure of the refrigerant in the refrigerant source is denoted by $P_S$, while $P_{SC}$ represents the pressure during the suction stroke. The condition of $P_{SC}<P_S$ is therefore established due to pressure drop.

In the described embodiments of the invention, the capacity control is effected by shutting off one of two suction ports leading to the vane chamber of the compressor. An explanation will be made hereinunder as to the principle of the capacity control conducted in the compressor of the invention.

FIGS. 8A to 8E are illustrations of the suction stroke performed in the compressor of the invention when the capacity control is not effected.

Figure 8A:
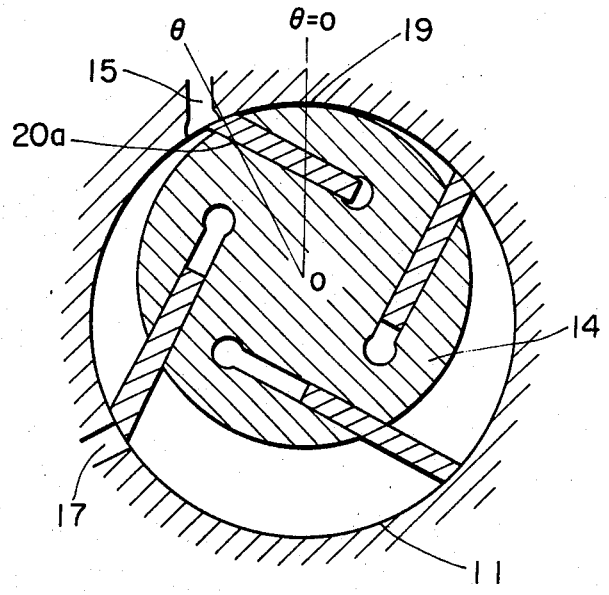
FIGS. 8A to 8E are illustration of the suction stroke of a sliding vane type rotary compressor of the invention.
Figure 8B:
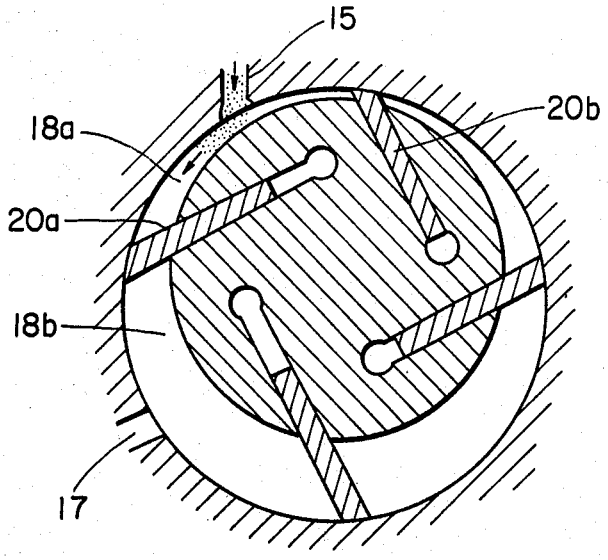
Figure 8C:
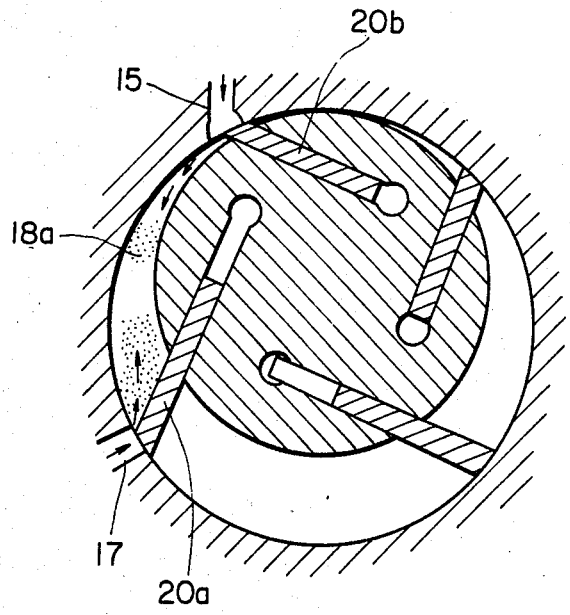
Figure 8D:
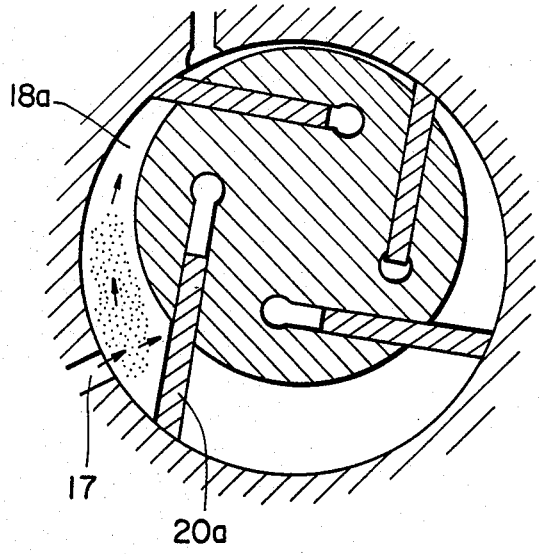
Figure 8E:
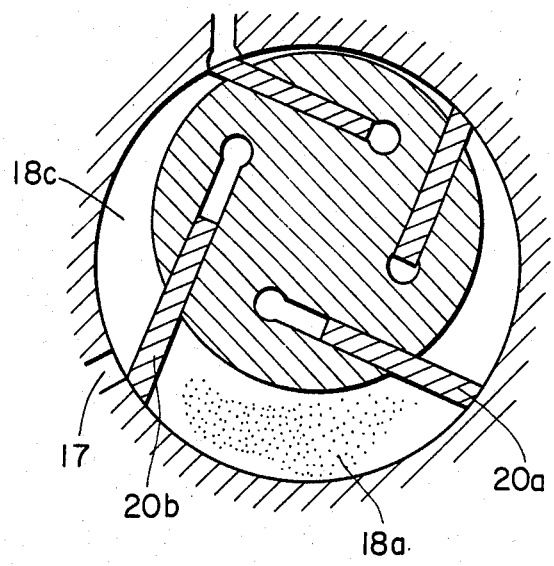

In these Figures, reference numerals **18*a*, 18*b* and 18*c* denote vane chambers, 19 denotes the top portion of the cylinder 11, and 20*a*, 20*b* denote vanes. The center of rotation of the rotor 14 is represented by O. The rotational position of the vane 20*a* is expressed by $\theta$ as measured from the reference position $\theta=0$ where the tip end of the vane coincides with the top 19 of the cylinder 11. FIG. 8A shows the state immediately after the vane 20*a* has passed the reference position, i.e., the top 19 of the cylinder, while FIG. 8B shows the state in which the vane 20*a* has been moved to a position intermediate between the first suction port 15 and the second suction port 17. Thus, in the states shown in FIGS. 8A and 8B, the vane chamber 18*a* is supplied with the refrigerant solely through the first suction port 15. FIG. 8C shows the state in which the leading vane 20*a* is just passing by the second suction port 17, while the trailing vane 20*b* is passing by the first suction port 15. In this state, the trailing vane 20*b* prevents the supply of the refrigerant from the first suction port 15 to the vane chamber 18*a*, the supply of the refrigerant via the second suction port 17 is started. The vane chamber 18*a* is supplied with the refrigerant only through the second suction port 17, as seen from FIG. 8D. In the state shown in FIG. 8E, the vane 20*b* has just passed the second suction port 17, so that the supply of the refrigerant through the second suction port 17 is cut off by the vane 20*b* to complete the suction stroke for the vane chamber 18*a* in this state. In the case of the illustrated embodiment, the rotational position of the leading vane 20*a* in the state shown in FIG. 8E is expressed by $\theta=\theta_{S1}\approx 225°$, and the vane chamber 18*a*** takes the maximum volume in this state.

Figure 9:
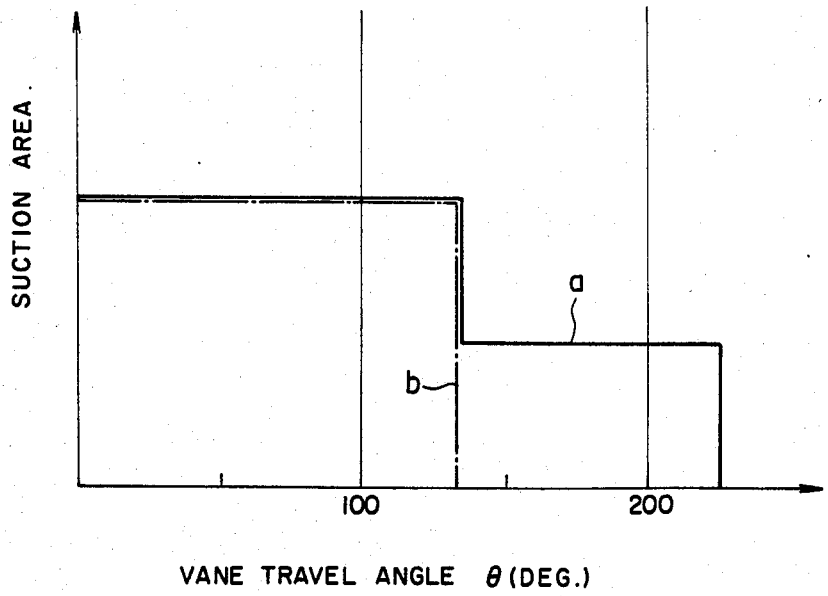
FIG. 9 is a graph showing a change in the suction area during the suction stroke of the sliding vane type rotary compressor of the invention.

FIG. 9 shows a change in the effective area of the flow passage leading to the vane chamber during the suction stroke. As in the case of FIG. 7, the state wherein the refrigerating capacity control is not conducted is shown by a curve a, whereas the curve b shows the state wherein the valve 25 (shown in FIG. 2) is in the shut-off position so that the supply of the refrigerant through the second suction port 17 is cut off. When the valve 25 is in the shut-off position, the supply of the refrigerant to the vane chamber **18*a*** as shown in FIGS. 8D and 8E does not occur.

Referring back to FIG. 7, the curve a shows the P-V characteristics as obtained when the refrigerating capacity control is not conducted, while the curve b shows the P-V characteristics as obtained when the refrigerating capacity control is suppressed. As seen from this Figure, the curve b exhibits an abrupt reduction in the refrigerant pressure from the point A ($\theta=135°$ in FIG. 9), which is caused by the cut-off of the flow passage. Consequently, the total weight of the refrigerant at the point B upon completion of the suction stroke is caused to be substantially reduced.

As described with respect to the above embodiments, the sliding vane type rotary compressor of the invention can be made substantially compact in construction as compared with conventional compressors incorporating a solenoid valve since the compressor of the invention suffices to be made long by a length corresponding a portion (for example, that is, the thickness of the intermediate plate 52 in FIG. 3) for receiving therein a spring made of a shape memory alloy and having a small diameter, as compared with a compressor in which capacity control can not be effected.

What is claimed is:

1. A sliding vane type rotary compressor including a rotor provided in the outer peripheral surface thereof with vane grooves which slidingly receive vanes; a cylinder rotatably accommodating said rotor and having an inner peripheral surface along which the ends of said vanes slide; first and second side plates fixed to opposite sides of said cylinder for closing the axial ends of vane chambers formed by said vanes, said rotor and said cylinder; at least two suction ports formed in one of said cylinder and said first side plate to allow a refrigerant having a low temperature to flow therethrough into said vane chambers; at least two flow passages providing communication between a source of said refrigerant and said vane chambers; and a delivery port formed in one of said cylinder and said first side plate to allow the refrigerant compressed in said vane chambers to be delivered to the outside, wherein the improvement comprises: a spring made of a shape memory alloy adapted to expand and contract in response to the heat produced by a self heat build-up action thereof when supplied with an electric current and the cooling effect produced by said low temperature refrigerant being brought into contact therewith, said spring of said shape memory alloy being disposed in a portion of one of said flow passages leading to one of said suction ports; and a spool disposed in said portion of said one of said flow passages, said spool being driven by said spring made of a shape memory alloy and adapted to open and close said flow passage by the force produced by said spring.

2. A sliding vane type rotary compressor according to claim 1, further comprising a passage formed in said spool to provide communication between the side of said spool adjacent said source of said refrigerant and the side of said spool adjacent said vane chambers.

3. A sliding vane type rotary compressor according to claim 1, wherein said spring made of shape memory alloy is housed in an insulating case.

4. A sliding vane type rotary compressor including a rotor provided in the outer peripheral surface thereof with vane grooves which slidingly receive vanes; a cylinder rotatably accommodating said rotor and having an inner peripheral surface along which the ends of said vanes slide; first and second side plates fixed to opposite sides of said cylinder for closing the axial ends of vane chambers formed by said vanes, said rotor and said cylinder; at least two suction ports formed in one of said cylinder and said first side plate to allow a refrigerant having a low temperature to flow therethrough into said vane chambers; at least two flow passages providing communication between a source of said refrigerant and said vane chambers; and a delivery port formed in one of said cylinder and said first side plate to allow the refrigerant compressed in said vane chambers to be delivered to the outside, wherein the improvement comprises: a spring made of a shape memory alloy adapted to expand and contract in response to the heat produced by a self heat build-up action thereof when supplied with an electric current and the cooling effect produced by said low temperature refrigerant being brought into contact therewith, said spring of said shape memory alloy being disposed in a portion of one of said flow passages leading to one of said suction ports; a spool disposed in said portion of said one of said flow passages, said spool being driven by said spring made of a a shape memory alloy and adapted to open and close said flow passage by the force produced by said spring of said shape memory alloy; and a biasing spring adapted for cooperating with said spring of said shape memory alloy in holding said spool at a predetermined position.

5. A sliding vane type rotary compressor according to claim 4, further comprising a passage formed in said spool to provide communication between the side of said spool adjacent said source of said refrigerant and the side of said spool adjacent said vane chambers.

6. A sliding vane type rotary compressor according to claim 4, wherein said spring made of a shape memory alloy is housed in an insulating case.

7. A sliding vane type rotary compressor including a flat rotor provided in the outer peripheral surface thereof with vane grooves which slidingly receive vanes; a cylinder rotatably accommodating said rotor and having an inner peripheral surface along which the ends of said vanes slide; rear and front side plates fixed to opposite sides of said cylinder for closing the axial ends of vane chambers formed by said vanes, said rotor and said cylinder; an intermediate plate disposed adjacent said rear plate having a first flow passage and a spool receiving aperture therein, said aperture being connected to said first flow passage; at least first and second suction ports for allowing a refrigerant having a low temperature to flow therethrough into said vane chambers; at least a second flow passage providing communication between a source of said refrigerant and said vane chambers; and a delivery port formed in one of said cylinder and said rear side plate to allow the refrigerant compressed in said vane chambers to be delivered to the outside, wherein said first suction port is formed in said rear plate and said first flow passage provides communication between said source of the refrigerant and said first suction port; and wherein said rotary compressor comprises a spool disposed in the aperture in said intermediate plate and adapted to open and close said flow passage; a spring made of a shape memory alloy adapted to expand and contract in response to the heat produced by a self heat build-up action thereof when supplied with an electric current and the cooling effect produced by said low temperature refrigerant being brought into contact therewith to drive said spool; and a biasing spring adapted for cooperation with said spring made of shape memory alloy in holding said spool at a predetermined position, said spring made of a shape memory alloy and said biasing spring being accommodated in respective cases and disposed at both sides of the aperture in said intermediate plate.

8. A sliding vane type rotary compressor according to claim 7, further comprising a passage formed in said spool to provide communication between the side of said spool adjacent said source of said refrigerant and the side of said spool adjacent said vane chambers.

9. A sliding vane type rotary compressor according to claim 7, wherein said case accommodating said spring made of shape memory alloy is made of an insulating material.

* * * * *